US007395937B2

(12) United States Patent
Sliwowski et al.

(10) Patent No.: US 7,395,937 B2
(45) Date of Patent: Jul. 8, 2008

(54) ADJUSTABLE BULLETIN BOARD

(76) Inventors: Shereen I. Sliwowski, 506 Laurie La., Aberdeen, NJ (US) 07747; Piotr Sliwowski, 506 Laurie La., Aberdeen, NJ (US) 07747

( * ) Notice: Subject to any disclaimer, the term of this patent is extended or adjusted under 35 U.S.C. 154(b) by 493 days.

(21) Appl. No.: 11/120,889

(22) Filed: May 3, 2005

(65) Prior Publication Data

US 2006/0249468 A1 Nov. 9, 2006

(51) Int. Cl.
*A47F 5/08* (2006.01)

(52) U.S. Cl. ..... 211/59.1; 211/57.1; 211/106.01

(58) Field of Classification Search ..... 211/119.13, 211/89.01, 124, 57.1, 59.1, 105.1, 45, 105.2, 211/106.01, 50; 248/220.31, 220.41
See application file for complete search history.

(56) References Cited

U.S. PATENT DOCUMENTS

| | | | | |
|---|---|---|---|---|
| 561,634 | A | 6/1896 | Walsh et al. | |
| 784,070 | A * | 3/1905 | Rhoads | 211/124 |
| 916,550 | A * | 3/1909 | Hale | 40/120 |
| 918,196 | A | 4/1909 | Price | |
| 1,489,923 | A | 4/1924 | Budd | |
| 1,785,988 | A * | 12/1930 | Sutcliffe | 211/57.1 |
| 1,980,587 | A | 11/1934 | Hayes | 276/1 |
| 2,650,714 | A * | 9/1953 | Brose et al. | 211/105.1 |
| 2,790,557 | A * | 4/1957 | Nemeth | 211/89.01 |
| 3,170,612 | A * | 2/1965 | Blumenschein | 294/143 |
| 3,327,376 | A | 6/1967 | Freeman et al. | 29/225 |
| 3,343,683 | A | 9/1967 | Wheeler | 211/89 |
| 3,489,382 | A * | 1/1970 | Larson | 248/220.42 |
| 3,524,616 | A * | 8/1970 | Marschak | 248/188.7 |
| 3,568,852 | A | 3/1971 | Howard | 211/113 |
| 3,984,002 | A | 10/1976 | Howard | 211/45 |
| 4,039,082 | A | 8/1977 | Ladinsky | 211/45 |
| 4,327,837 | A | 5/1982 | Ross | 211/87 |
| 4,446,973 | A | 5/1984 | Fuller et al. | 211/45 |
| 4,667,913 | A | 5/1987 | Peelle et al. | 248/228 |
| 4,802,265 | A * | 2/1989 | Stevenson | 24/335 |
| 4,884,350 | A | 12/1989 | Whetstone | 40/124 |
| 5,236,163 | A * | 8/1993 | Valiulis | 248/220.41 |
| 5,303,830 | A * | 4/1994 | Metcalf | 211/57.1 |
| 5,601,197 | A | 2/1997 | Baxter | 211/117 |
| 5,645,178 | A | 7/1997 | Conley, Jr. | 211/87.01 |
| 5,779,065 | A * | 7/1998 | Thalenfeld et al. | 211/87.01 |
| 5,927,517 | A * | 7/1999 | Lipman et al. | 211/59.1 |
| 6,942,112 | B2 * | 9/2005 | Robbins, III | 211/113 |
| D522,285 | S * | 6/2006 | Moore, Jr. | D6/513 |
| D536,906 | S * | 2/2007 | Robbins, III | D6/467 |
| 2004/0256338 | A1 * | 12/2004 | McGarry et al. | 211/94.01 |

* cited by examiner

*Primary Examiner*—Jennifer E. Novosad
(74) *Attorney, Agent, or Firm*—Watov & Kipnes, P.C.; Kenneth Watov

(57) ABSTRACT

A bulletin board is provided by a backboard mounted within a frame, with a plurality of semicircular rods successively mounted in a desired spaced apart relationship on said board, the rods being concentric with one another and of successively decreased diameter, with a plurality of alligator-like clips being slideably hung from each of said rods. The spacing of the rods is adjustable.

10 Claims, 7 Drawing Sheets

3
14
15
14
15
14
15

ADJUSTABLE BULLETIN BOARD

FIELD OF THE INVENTION

The present invention relates generally to bulletin boards, and more specifically to bulletin boards providing for clipping on articles such as paper messages, and so forth.

BACKGROUND OF THE INVENTION

Various bulletin board designs have been developed over the years. Some of the simplest designs utilize cork bulletin boards for permitting memos, messages, or sheet paper for display, to be thumb tacked or pinned onto the bulletin board surface. Other designs have provided message racks, paper racks, and display systems, incorporating slidable clothes pegs, or clips, for retaining messages and memos. There is a need in the art for further development of bulletin boards to facilitate the movement of messages thereon, and the efficient retrieval of a particular one of the messages, memos, or other items attached to the bulletin board for later review or retrieval.

SUMMARY OF THE INVENTION

It is on object of the invention to provide an improved bulletin board.

Another object of the invention is to provide an adjustable bulletin board that permits efficient display and retrieval of items attached to the bulletin board.

With these and other objects in mind, a rectangular bulletin board is installed within a frame in a manner permitting the assembly to be hung on a wall, or stood upright on a desk. A plurality of semicircular rods having ends formed for secure attachment to the bulletin board are adjustably spaced apart. A plurality of alligator-like clips are moveably attached to the semicircular rod for holding items such as paper for display, memos, and so forth on the bulletin board. In one embodiment of the invention, the semicircular rods are from the top of the bulletin board down, or vice versa, of successively smaller diameter, whereby the semicircular rods are concentric with one another.

BRIEF DESCRIPTION OF THE FIGURES

The present invention is described in detail below with reference to the figures, in which like items are identified by the same reference designation, wherein.

DETAILED DESCRIPTION OF THE INVENTION

Figure 1:
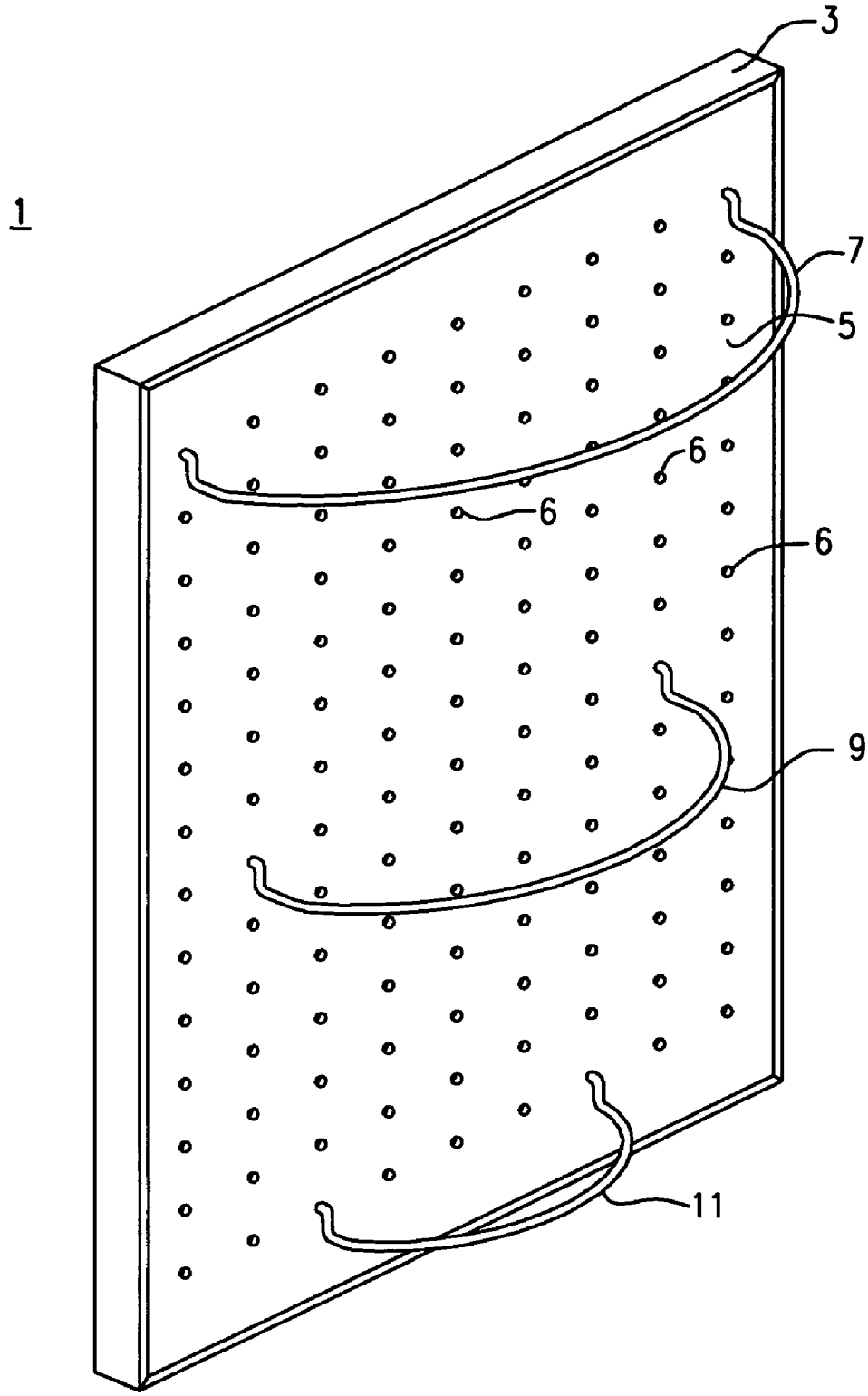
FIG. 1 is a pictorial view of one embodiment of the present bulletin board invention.

With reference to FIG. 1, in a preferred embodiment of the invention a frame 3 is formed to retain a peg board 5. However, the invention is not limited to use of a peg board. In this example, three circular rods 7, 9, and 11, respectively, are each formed into a semicircle, with each having their ends configured for permitting the rods to be connected to the peg board 5, as shown, or other type of board used. In the preferred embodiment of the invention, the diameters of the semicircular rods 7, 9, and 11 are successively smaller, whereby the rods 7, 9, and 11 respectively, are concentric with one another, as shown in the top view of the bulletin board 1 of FIG. 4. Note that more or less than three semicircular rods can be secured to the peg board 5, whereby the invention is not meant to be limited to the use of three such circular rods each formed into a semicircle as in this example. Also, the semicircular mounting rods 7, 9, and 11, in this example, can be mounted with rod 11 on the top portion of the peg board 5, and rod 7 on the bottom portion of the peg board 5.

Figure 2:
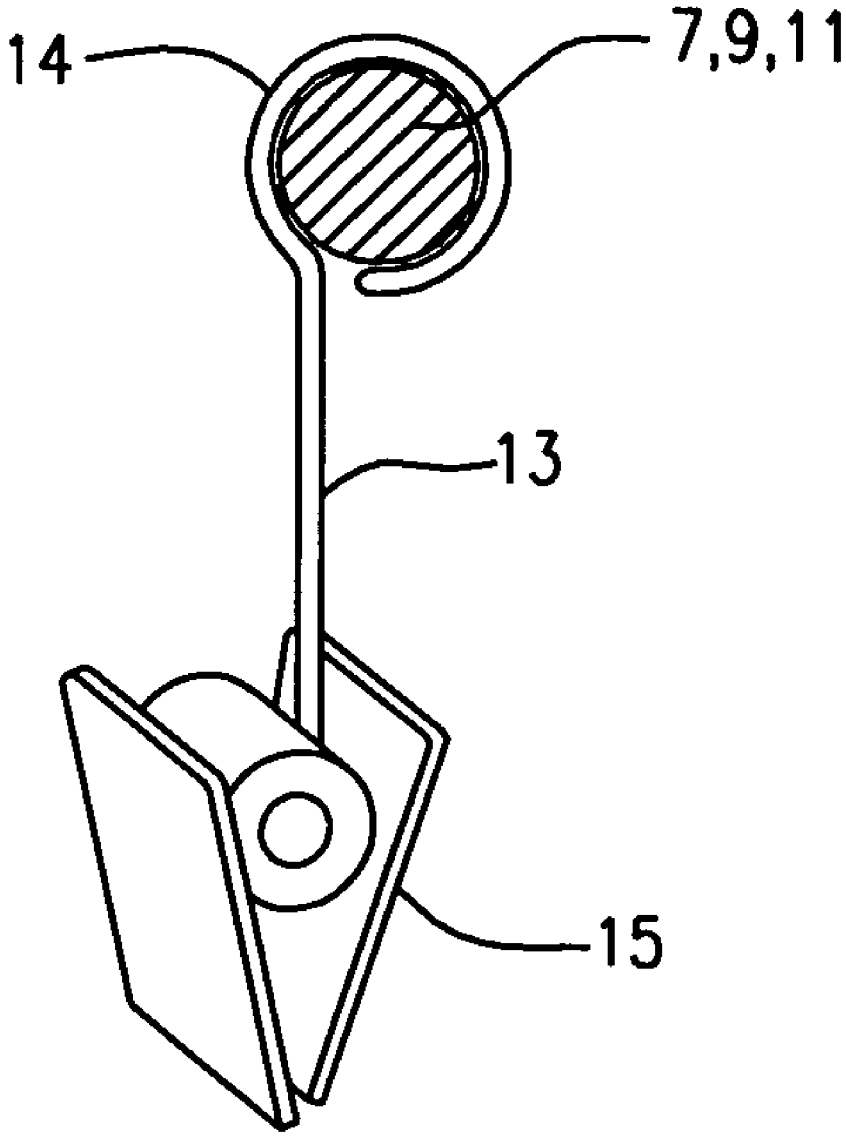
FIG. 2 is a partial pictorial view showing one embodiment of the invention for moveably hanging a alligator-like clip on various ones of a plurality of circular rods attached to the bulletin board for an embodiment of the invention.
Figure 3:
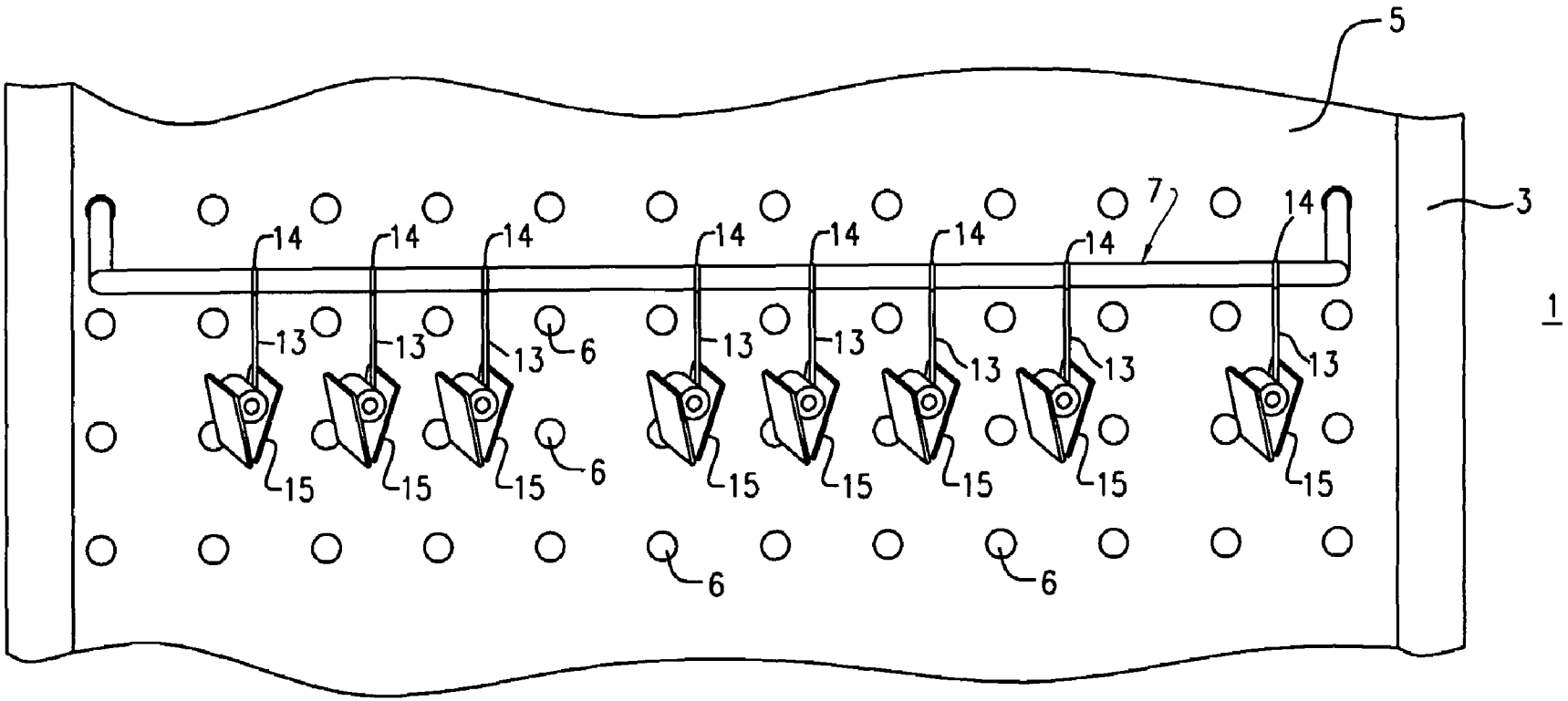
FIG. 3 shows a front elevational view of a circular rod attached to a portion of the present bulletin board along with a plurality of alligator-like clips moveably attached to the circular hanger rod.

With reference to FIG. 2, a plurality of alligator-like clips 15 can be moveably hung from each of the rods 7, 9, and 11 through use of a hanger wire 13 having one end secured to the alligator-like clip 15, yet allowing for twisting (turning) it horizontally, and its other end formed to captively fit around the outside diameter of an associated one of rod 7, 9, and 11, for example. In this manner, the alligator-like clip 15 can be slid along its associated rod to any desired position thereon. Also, in this manner, a plurality of alligator-like clips 15 are hung from each one of the rods 7, 9, and 11, respectively, in this example. Note that FIG. 3 shows a portion of the peg board 5 on which a plurality of the clips 15 have been moveably mounted on rod 7. The clips 15 can be turned, and can be positioned sideways or front ways, for example. The clips 15 are also able to slightly turn horizontally to allow for overlapping of papers and notes. Also note that the top view of the embodiment of FIG. 4 also shows a plurality of clips 15 mounted upon each one of the rods 11, 9, 7, respectively.

Figure 4:
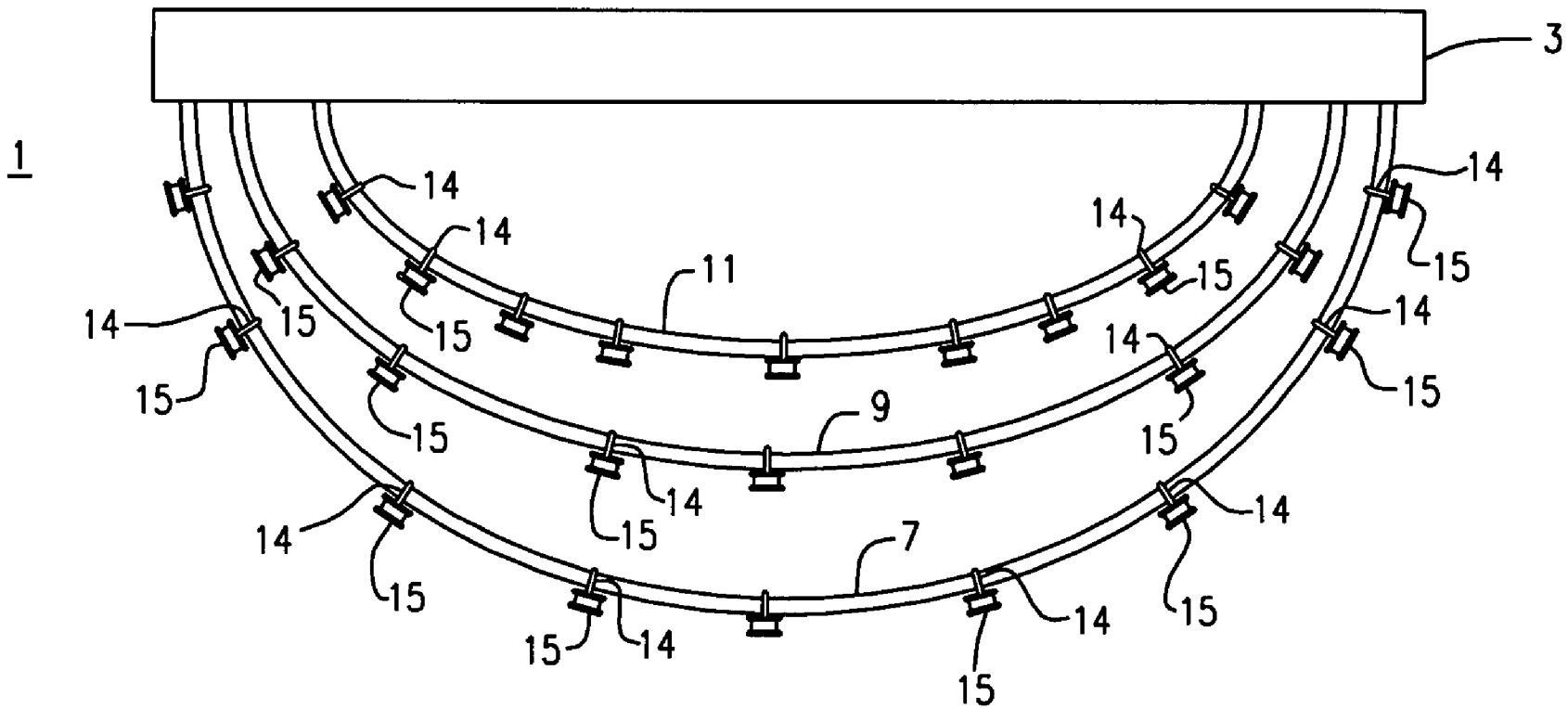
FIG. 4 shows a top view of the embodiment of the invention of FIG. 1, with the addition of a plurality of alligator-like clips being hung from the three spaced apart concentric circular rods.
Figure 5:
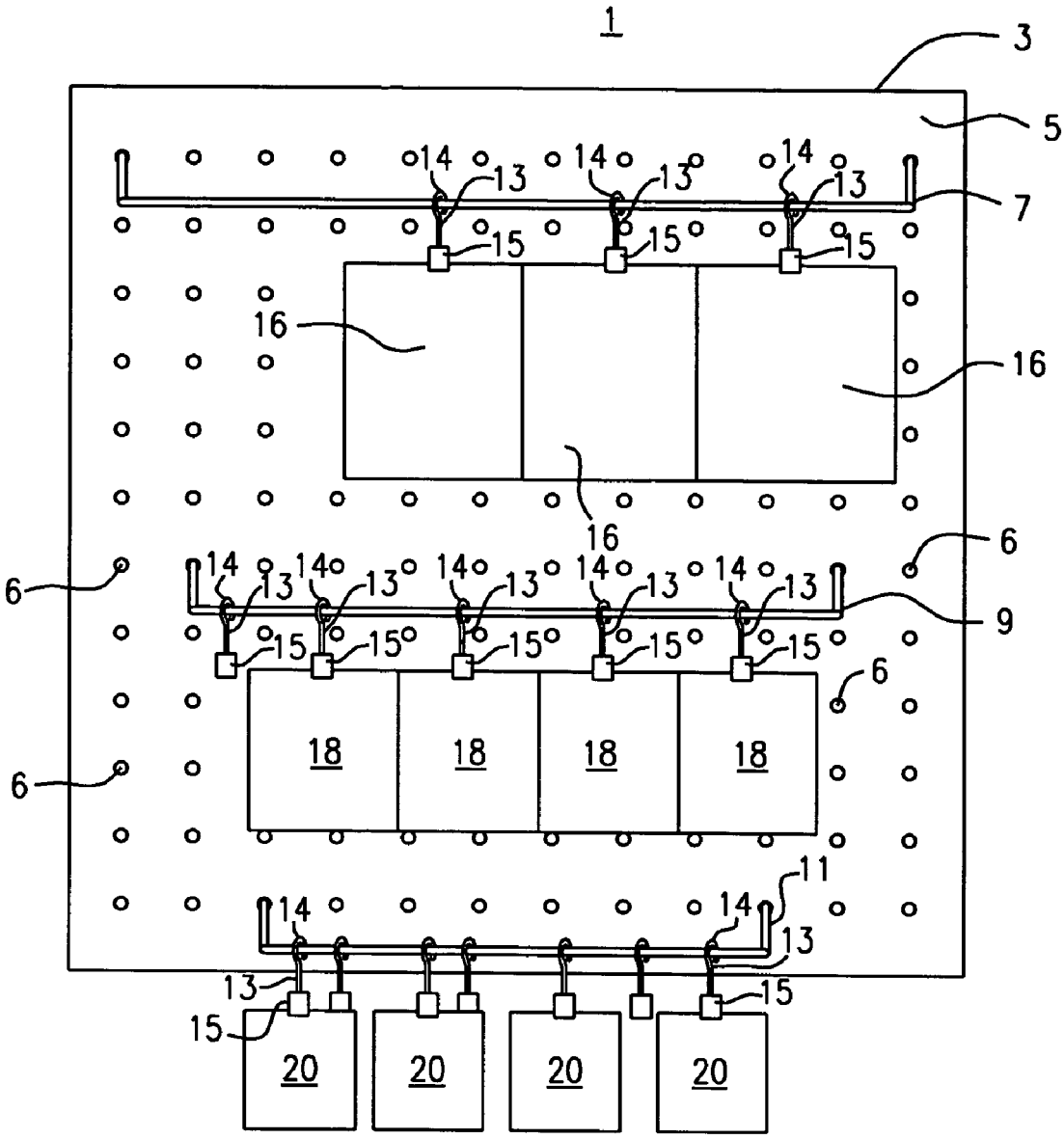
FIG. 5 shows a front elevational view of the embodiment of the invention of FIGS. 1 and 4 with a plurality of messages, memos, and so forth hanging from the alligator-like clips connected to the semicircular bars or rods installed on the bulletin board peg board.

FIG. 5 shows a front elevational view of the embodiment of the invention of FIGS. 1, 2, and 4, but with items 16, 18, 20 such as sheets of paper for display, memos, and so forth hung from the rods 7, 9, and 11. The items 16, 18, 20 can be positioned overlapping one another, in non-overlapping position, or some overlapping and others not overlapping. More particularly, items 16 are hung from rod 7, items 18 from rod 9, and items 20 from 11. Through use of the successively smaller diameter rods 7, 9, and 11, for the preferred embodiment of the invention, items hung from the bulletin board via the alligator-like clips 15 can be more readily observed, and recovered for removal and use, in an efficient manner. The spacing between the rods 7, 9, and 11 can be adjusted, and the items hung from these rods adjustably spaced along each associated rod, for preventing various of the items from being hidden by overlaying items, thereby permitting rapid retrieval of a given item without having to move the memos around in order to locate the desired one. The easily movable nature of the attachment of the alligator-like clips 15 on the rods 7, 9, 11 allows for easy movement of items hung allowing for a multitude of items to be stored yet providing unobstructed view when moved.

Figure 6:
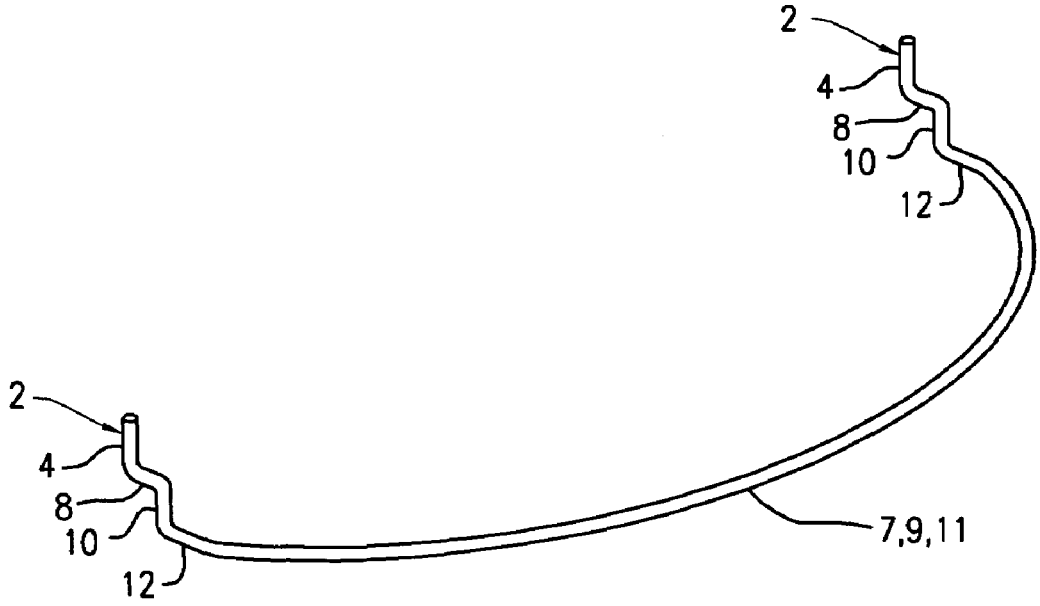
FIG. 6 shows a design for a semicircular rod or bar for one embodiment of the invention.
Figure 7:
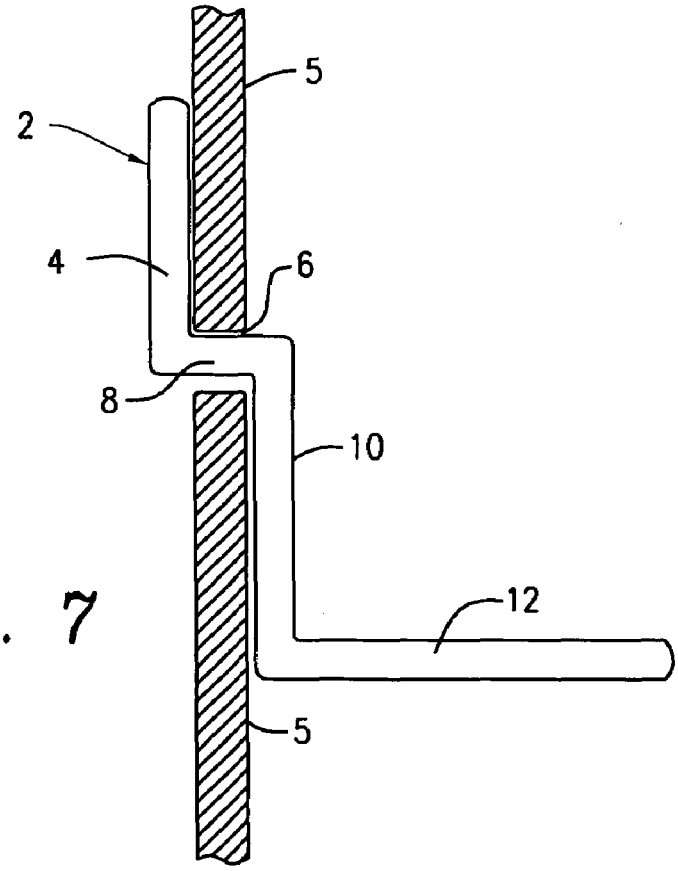
FIG. 7 shows a partial cross sectional view of the connection of an end of the semicircular rod of FIG. 6 in a hole of the peg board of the present invention for one embodiment thereof.

In another embodiment of the invention, the semicircular rods 7, 9, and 11 each have their free ends bent into four sections, 4, 8, 10, and 12, as shown in FIG. 6, for securement to a peg board 5, through a hole 6 of the peg board 5, as shown in FIG. 7.

Figure 8:
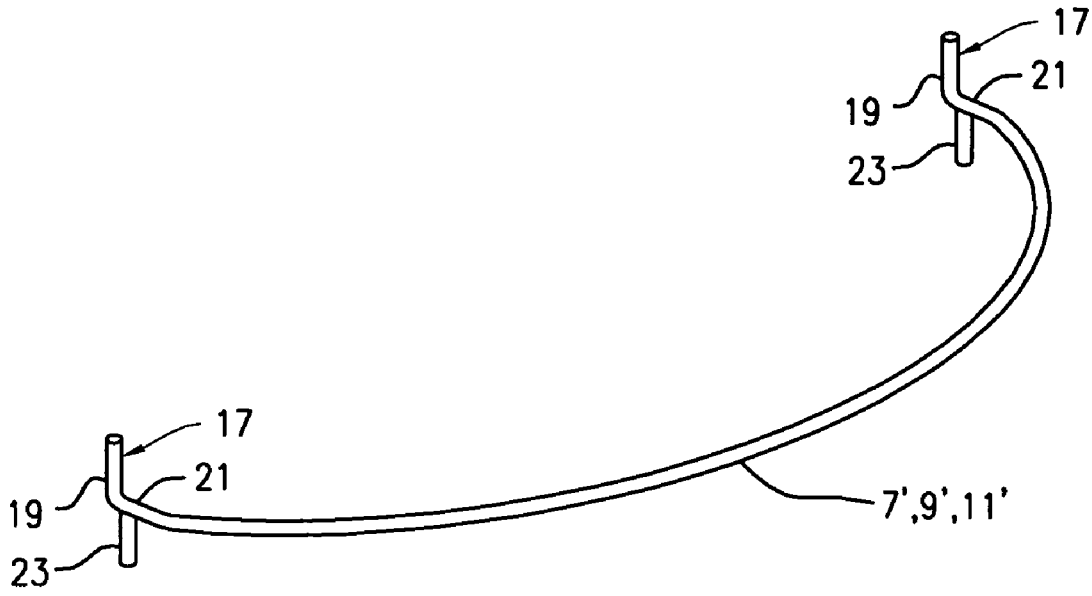
FIG. 8 shows an alternative embodiment of the invention for the design of the semicircular rods thereof.
Figure 9:
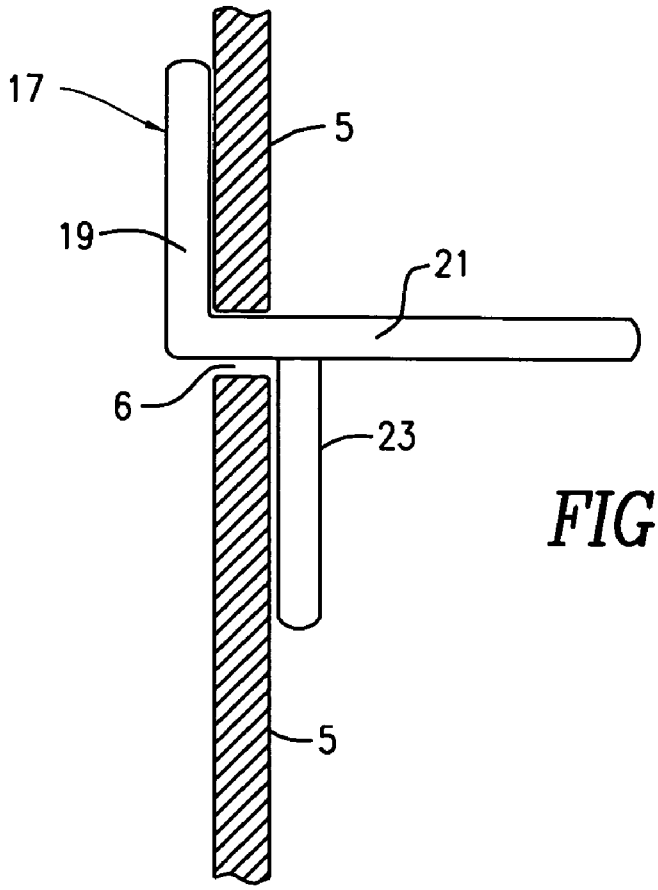
FIG. 9 shows a partial cross sectional view of an end portion of the semicircular rod of FIG. 8 connected within a hole of the peg board of the present invention.

In another embodiment of the invention, as shown in FIG. 8, the rods designated as 7', 9', 11', respectively, have their free ends 17 formed into three sections 19, 21, and 23 as shown, for mounting upon the bulletin board 5 as shown in FIG. 9.

Note that the preferred embodiment of the invention for providing the rods 7, 9, and 11 in a semicircular form, of successively reduced diameter, respectively, facilitates hanging items from the rods, while minimizing the items from interfering with one another, as previously mentioned. For example, items hung from rod 7 will hang outwardly and spaced apart from items hung from rod 9, and items hung from rod 9 will extend outwardly and spaced away from items hung from rod 11. This preferred design facilitates, as previously mentioned, the retrieval of any given item hung from the bulletin board 1.

Although various embodiments of the invention have been shown and described above, they are not meant to be limiting. Those of skill in the art may recognize certain modifications to these embodiments, which modifications are meant to be covered by the spirit and scope of the appended claims. For example, the rods 7, 9, and 11 can have other than a semicircular shape. Also, more or less than three rods can be used. Also, means other than the illustrated alligator-like clips can be used for attaching paper messages and like to the rods 7, 9, and 11. In addition, the rods 7, 9, and 11 can be attached to a backboard other than a peg board 5, and have appropriate attachment means for the type of board material used. As previously indicated, the invention is not limited to use of a peg board 5, and the material used whether a peg board or otherwise, can be any suitable material, such as wood, plastic, heavy cardboard, metal, and so forth.

What we claims is:

1. A bulletin board comprising:

a frame;

a peg board mounted within said frame;

a plurality of rigid rods, each of said plurality of rods having free ends configured for transversely mounting said rods onto said peg board, wherein a first portion of each free end is vertically disposed adjacent a rear surface of the peg board and a second portion of each free end is disposed vertically adjacent a front surface of the peg board, and the free ends further having a semicircular portion therebetween configured for extending from the front surface of the peg board upon mounting thereon, wherein the semicircular portion having opposite end portions connected to the second portions and the semicircular portion comprises a substantially constant curvature extending along the entire length thereof from a first one of the second portions to the other second portion;

each of said plurality of rods being transversely successively mounted on said peg board in any desired spaced apart relationship; and a plurality of manually operable clips slidably mounted upon each of said plurality of rods, each of said clips being adapted for twisting or turning horizontally, while remaining mounted thereupon, and for permitting sheet configured items including memos, notes, displays, and other such items to be removably connected to a respective one of said clips on an associated one of said plurality of rods, for hanging down therefrom.

2. The bulletin board of claim 1, wherein said curvatures of said plurality of rigid rods are of successively decreasing diameter.

3. A method for providing an adjustable bulletin board comprising the steps of:

mounting a peg board within a frame;

forming a plurality of rigid rods, each of said plurality of rods having free ends, and a semicircular portion;

configuring the free ends of said plurality of rigid rods to permit said rods to each be transversely mounted on said peg board;

configuring a portion of each of the free ends to be vertically disposed adjacent a rear surface of the peg board, configuring a second portion of each of the free ends to be disposed vertically adjacent a front surface of the peg board, and configuring the semicircular portion therebetween, configuring the semicircular portion of each of said plurality of rods to have opposite end portions thereof connected to the second portions and configuring the semicircular portion to extend from the front surface of the peg board upon mounting thereon, wherein the semicircular portion comprises a substantially constant curvature extending along the entire length thereof from a first one of the second portions to the other second portion;

mounting said plurality of rods in spaced apart relation on said peg board; and slidably mounting a plurality of clips on each one of said plurality of rods, each of said clips being adapted for twisting or turning horizontally, while remaining mounted thereupon, and for permitting items to be removably attached thereto and hanging down therefrom.

4. The bulletin board of claim 3, wherein said forming step further includes making said curvatures of said plurality of rigid rods to have successively decreasing diameters.

5. A bulletin board comprising:

a backboard adapted for hanging on a wall or sitting upright on a surface;

a plurality of rigid rods, each of said plurality of rods having free ends configured for transversely mounting said rods onto said backboard, wherein a first portion of each free end is vertically disposed adjacent a rear surface of the backboard and a second portion of each free end is disposed vertically adjacent a front surface of the backboard, and the free ends further having a semicircular portion therebetween configured for extending from the front surface of the backboard upon mounting thereon, wherein the semicircular portion having opposite end portions connected to the second portions and the semicircular portion comprises a substantially constant curvature extending along the entire length thereof from a first one of the second portions to the other second portion;

each of said plurality of rods being transversely successively mounted on said backboard in any desired spaced apart relationship; and a plurality of manually operable clips slidably mounted upon each of said plurality of rods, each of said clips being adapted for twisting or turning horizontally, while remaining mounted thereupon, and for permitting sheet configured items including memos, notes, displays, and other such items to be removably connected to a respective one of said clips on an associated one of said plurality of rods, for hanging down therefrom.

6. The bulletin board of claim 5, wherein said curvatures of said plurality of rigid rods are of successively decreasing diameter.

7. The bulletin board of claim 5, wherein said backboard consists of a peg board.

8. A method for providing an adjustable bulletin board comprising the steps of:

forming a backboard for hanging on a wall or sitting upright on a surface;

forming a plurality of rigid rods, each of said plurality of rods having free ends, and a semicircular portion;

configuring the free ends of said plurality of rigid rods to permit said rods to each be transversely mounted on said backboard;

configuring a portion of each of the free ends to be vertically disposed adjacent a rear surface of the backboard, configuring a second portion of each of the free ends to be disposed vertically adjacent a front surface of the backboard, and configuring the semicircular portion therebetween, configuring the semicircular portion of each of said plurality of rods to have opposite end portions thereof connected to the second portions and configuring the semicircular portion to extend from the front surface of the backboard upon mounting thereon, wherein the semicircular portion comprises a substantially constant curvature extending along the entire length thereof from a first one of the second portions to the other second portion;

mounting said plurality of rods in spaced apart relation on said backboard; and slidably mounting a plurality of clips on each one of said plurality of rods, each of said clips being adapted for twisting or turning horizontally, while remaining mounted thereupon, and for permitting items to be removably attached thereto and hanging down therefrom.

9. The bulletin board of claim 8, wherein said forming step further includes making said curvature of said plurality of rigid rods to have successively decreasing diameters.

10. The bulletin board of claim 8, wherein said backboard consists of a peg board.

* * * * *